US006913673B2

(12) United States Patent
Baggot et al.

(10) Patent No.: US 6,913,673 B2
(45) Date of Patent: Jul. 5, 2005

(54) HEATED EMBOSSING AND PLY ATTACHMENT

(75) Inventors: James L. Baggot, Menasha, WI (US); Tammy L. Baum, Neenah, WI (US); Paul K. Pauling, Appleton, WI (US); James A. Wood, Hortonville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/025,190

(22) Filed: Dec. 19, 2001

(65) Prior Publication Data

US 2003/0111169 A1 Jun. 19, 2003

(51) Int. Cl.[7] ..... D21F 27/30; B31F 1/07

(52) U.S. Cl. ..... 162/117; 162/109; 162/123; 162/132; 428/153; 428/154; 156/209

(58) Field of Search ..... 162/109–117, 361–2, 162/205–6, 123, 132, 358.5; 156/196, 199, 209, 219; 428/152–4, 174; 264/119, 280, 284; 101/3.1, 22, 32

(56) References Cited

U.S. PATENT DOCUMENTS

| | | | | |
|---|---|---|---|---|
| 777,129 | A | | 12/1904 | Nicollet |
| 918,525 | A | | 4/1909 | Franz |
| 1,143,333 | A | | 6/1915 | Tompkins et al. |
| 1,196,181 | A | | 8/1916 | Tompkins et al. |
| 1,714,261 | A | | 5/1929 | Egan et al. |
| 1,808,536 | A | | 6/1931 | Fisk |
| 1,929,924 | A | | 10/1933 | Jopson |
| 2,095,199 | A | | 10/1937 | Speed |
| 2,188,222 | A | | 1/1940 | Hibbs |
| 2,611,312 | A | | 9/1952 | Illner |
| 2,803,188 | A | * | 8/1957 | Duvall ..... 101/32 |
| 2,834,809 | A | | 5/1958 | Schutte et al. |
| 2,890,540 | A | * | 6/1959 | Britt ..... 264/284 |

(Continued)

FOREIGN PATENT DOCUMENTS

| | | |
|---|---|---|
| CA | 1037754 | 9/1978 |
| EP | 101203 | 2/1984 |
| EP | 0770477 A3 | 5/1997 |
| EP | 0770477 A2 | 5/1997 |
| GB | 1420139 | 1/1976 |
| GB | 2255745 | 11/1992 |
| WO | 9406623 | 3/1994 |
| WO | WO 0147699 A1 | 7/2001 |

OTHER PUBLICATIONS

"Basis Weight and Grammage Conversion Tables", EDS Inc., Dec. 17, 2000.*

Abstract of Japanese Patent No. 2002017607, Jan. 22, 2002.

PCT Search Report, Apr. 10, 2003.

*Primary Examiner*—Eric Hug

(74) *Attorney, Agent, or Firm*—Dority & Manning, P.A.

(57) ABSTRACT

The present invention is generally directed to a process for hot embossing a base sheet and/or to a process for perforating and bonding multiple plies of a paper product together. The process can be used in order to apply a decorative pattern to a paper product and/or to bond multiple ply products together. In one embodiment, the process of the present invention includes feeding a previously formed single ply or multi-ply base sheet through a heated embossing nip. As the base sheet passes through the heated embossing nip, sufficient heat and pressure is imparted to cause the fibers within the sheet to begin to melt or glassinate. Upon cooling, inter-fiber bonding occurs resulting in a well-defined embossment as well as bonding between plies of a multi-ply product.

34 Claims, 11 Drawing Sheets

U.S. PATENT DOCUMENTS 3,301,173 A 1/1967 Moody
3,323,983 A * 6/1967 Palmer et al. ..... 162/362
3,377,224 A * 4/1968 Gresham et al. ..... 156/209
3,590,695 A 7/1971 Gerard
3,625,791 A * 12/1971 Lee et al. ..... 156/194
RE27,453 E 8/1972 Schutte et al.
3,806,406 A 4/1974 Ely
3,825,381 A 7/1974 Dunning et al.
3,834,286 A 9/1974 Nystrand
3,846,228 A 11/1974 Ely et al.
3,867,872 A 2/1975 Nystrand
3,940,529 A 2/1976 Hepford et al.
3,949,035 A 4/1976 Dunning et al.
3,953,634 A 4/1976 Wooten
3,969,992 A 7/1976 Calderazzo
4,100,017 A 7/1978 Flautt, Jr.
4,135,024 A 1/1979 Callahan et al.
4,166,758 A * 9/1979 Watanabe et al. ..... 162/117
4,191,609 A 3/1980 Trokhan
4,216,055 A 8/1980 Watanabe et al.
4,252,184 A 2/1981 Appel
4,257,842 A * 3/1981 Ciaccia et al. ..... 162/117
4,257,843 A 3/1981 Watanabe et al.
4,302,282 A 11/1981 Young
4,513,051 A 4/1985 Lavash
4,740,409 A 4/1988 Lefkowitz
4,760,239 A * 7/1988 Makin ..... 219/121.85
4,968,291 A 11/1990 Baldacci et al.
4,986,883 A 1/1991 Taipale et al.
5,114,771 A 5/1992 Ogg et al.
5,126,015 A 6/1992 Pounder
5,143,776 A 9/1992 Givens
5,158,523 A 10/1992 Houk et al.
5,209,953 A * 5/1993 Grupe et al. ..... 427/276
5,318,670 A 6/1994 Link et al.
5,360,502 A 11/1994 Anderson
5,543,202 A 8/1996 Clark et al.
5,562,964 A 10/1996 Jones
5,727,458 A 3/1998 Schulz
5,755,654 A 5/1998 Schulz et al.
5,989,682 A 11/1999 Anderson
6,030,690 A * 2/2000 McNeil et al. ..... 428/156
6,077,390 A * 6/2000 Salman et al. ..... 162/117
6,454,905 B1 * 9/2002 Hollmark et al. ..... 162/206
6,458,447 B1 * 10/2002 Cabell et al. ..... 428/167

* cited by examiner

HEATED EMBOSSING AND PLY ATTACHMENT

BACKGROUND OF THE INVENTION

Consumer paper products such as facial tissue, bath tissue and paper wipers are generally used to absorb liquids and fluids. Such paper products are predominantly formed of cellulosic papermaking fibers by manufacturing techniques designed specifically to produce several important properties. For example, the products should have good bulk, a soft feel, and should be highly absorbent. Further, the products should also have a pleasant aesthetic appearance and should be resilient against delamination in the environment in which they are used.

In the past, many attempts have been made to enhance certain physical properties of such products. For instance, to enhance the aesthetic appearance, a decorative paper product was created by embossing a pattern onto one or both sides of the paper web during manufacturing. This standard mechanical embossing resulted in the deformation or breaking of fibers in an attempt to physically press the pattern into the web. In some applications, the resulting embossed patterns were not well-defined and faded as the paper product aged. Thus, a need exists for an improved decorative paper product with a clear and resilient embossed pattern.

Further, a variety of approaches have been employed over the years in an attempt to improve the bonding properties between multiple plies of paper products. One approach includes applying an adhesive between the plies before passing the paper web through a nip under pressure. Another approach includes using paper plies having different creping characteristics to form a bonded paper product with fiber entanglement. Although these processes provide suitable multi-ply paper products, delamination between the plies still occurs. Therefore, a need also exists for improved bonding between multiple plies of paper products.

SUMMARY OF THE INVENTION

The present invention is directed to improvements in the quality of paper products. In particular, the present invention is directed to a process for producing an embossed paper product having an improved aesthetic appearance as well as a multi-ply paper product having improved ply bondage. The present invention is also directed to the improved paper products produced by the process.

In one embodiment, the process of the present invention includes forming a base web containing pulp fibers and guiding the formed base web through a heated embossing nip including a pattern roll and a backing roll. The web is subjected to suitable heat and pressure within the embossing nip such that inter-fiber bonding occurs within the web at fiber bonding areas. Fiber bonding areas are defined as those areas where the web contacts the bonding elements of the pattern roll. The resulting well-defined embossed pattern can additionally possess a glassine appearance.

The process of the present invention can additionally be suitable for a multi-ply product. In this case, the base sheet which is guided through the embossing nip can include two or more plies. The temperature and pressure applied at the embossing nip can then result in a well-defined embossed pattern as well as bonding between adjacent plies of the base sheet.

The embossing nip can be heated in any suitable fashion. For example, the embossing nip can be heated by heating the pattern roll. Alternatively, in those embodiments wherein the backing roll is not a rubber coated backing roll, for example, if the backing roll is a steel backing roll, the embossing nip may be heated by heating the backing roll or even both the pattern roll and the backing roll. Any suitable method of heating the roll(s) can be used. For example, heating can be achieved by circulating a hot fluid within the roll. In general, the embossing nip can be heated to a temperature of between about 100° F. and about 500° F. More specifically, the embossing nip can be heated to a temperature of between about 180° F. and about 490° F.

In one possible embodiment, the base sheet can be preheated prior to entering the embossing nip. In such an embodiment, the base sheet can be guided around a portion of the heated roll prior to entering the embossing nip. For example, the base sheet can be guided around the heated roll from about a 30° to about a 270° wrap angle in order to preheat the base sheet prior to entering the embossing nip.

The pressure applied to the base sheet at the embossing nip is generally less than about 500 pli. More specifically, the pressure at the embossing nip can be between about 100 pli and about 400 pli.

The residence time of the base sheet within the embossing nip can generally be between about 2.5 msec and about 25 msec.

The embossing pattern utilized in the process can be any decorative pattern, such as, for example, a pattern formed of discrete shapes, a reticulated pattern, or some combination thereof. The embossing pattern can generally cover about 2% to about 60% of the total surface area of the embossed sheet. Specifically, the embossing pattern can cover about 5% to about 30% of the total surface area of the embossed sheet.

The present invention is also directed to paper products produced by the disclosed process. The paper product can include pulp fiber and can generally have a basis weight of from about 6 lbs/ream to about 70 lbs/ream. For example, the paper product can be a single ply or multi-ply tissue product. In an embodiment wherein a tissue product is formed, the tissue product can generally have a basis weight of between about 6 lbs/ream and about 50 lbs/ream.

In one embodiment, pulp fibers can make up about 80% by weight of the product. Alternatively, the paper product can be formed exclusively of pulp fibers. Products produced by the present invention can generally have an absorbency of from about 5 grams $H_2O$/gram fiber to about 9 grams $H_2O$/gram fiber.

In an alternative embodiment, the present invention is directed to a method of contemporaneously perforating and attaching a plurality of pulp fiber plies together. In this embodiment, the method includes the steps of arranging the plurality of pulp fiber plies in an overlapping configuration. The plies are then perforated to form separate sheets along the length of the plies. According to the present invention, during perforation, the plies are pressed and fused together adjacent the formed perforations under a pressure sufficient to cause the plies to glassine and fuse together. Consequently, the plies are perforated and fused together in a single step.

During perforation, the plurality of plies can be bunched together adjacent the formed perforations to form larger bond areas. Also, the ply or the perforating device can be heated during formation of the perforation lines to facilitate fusing.

In order to perforate a multiply product, a perforating apparatus can be used that includes a plurality of perforator blades. The perforator blades include a plurality of teeth that have a chamfered flat surface. The perforator blades are attached to a rotating perforator head.

Opposite the perforator head is positioned an anvil having an angled surface. The angled surface is positioned so as to contact the perforator blades as they are rotated on the perforator head. During a perforation operation, a paper web is fed between the anvil and the perforator blades. The chamfered surface of the perforator blade contacts the paper web as the paper web contacts the anvil. As the perforator blade slides across the anvil, a perforation is formed in the paper web. Further, sufficient pressure is applied to the paper web to cause the fibers surrounding the formed perforations to fuse together and bond.

In this embodiment, multi-ply paper products can be produced that include rows of perforations spaced apart along the length of the paper product. Bond areas are defined adjacent to the perforations that attach the plies together. The bond areas include areas where pulp fibers from the first ply have been glassiningly fused together with pulp fibers from an adjacent ply.

Other aspects and features of the present invention will be discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
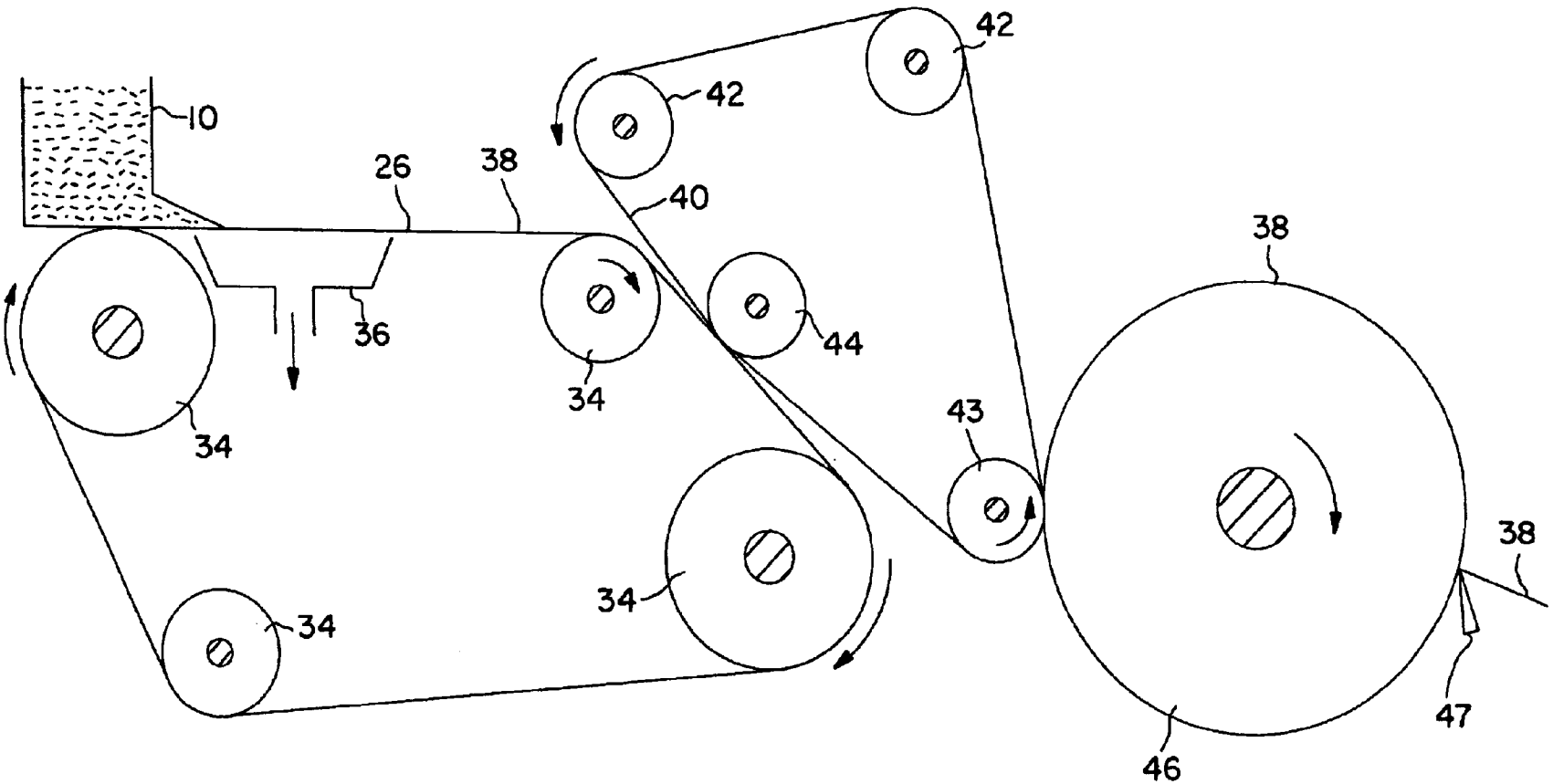
FIG. 1 is a schematic diagram of a fibrous web forming machine that crepes one side of the web.

Repeat use of reference characters in the present specification and drawings is intended to represent same or analogous features or elements of the present invention.

DETAILED DESCRIPTION OF THE PREFERRED EMBODIMENTS

It is to be understood by one of ordinary skill in the art that the present discussion is a description of exemplary embodiments only, and is not intended to limit the broader aspects of the present invention which broader aspects are embodied in the exemplary construction.

The present invention, in one embodiment, is generally directed to a process for hot embossing paper products. The present invention is also directed to the paper products produced by this process. The process can be used in order to apply a decorative pattern to a paper product and/or to bond multiple ply products together. Of particular advantage, in one embodiment, the process of the present invention can provide a paper product having an improved appearance. In particular, the heated embossing process can provide a more clearly defined and more resilient embossed pattern to the paper product. Further, when utilized in a multi-ply product process, the heated embossing method can provide improved bondage between the individual plies.

In general, the process of the present invention includes feeding a previously formed single or multi-ply base sheet through an embossing nip. In one possible embodiment, the embossing nip is formed between a heated pattern roll and a backing roll. As the base sheet passes through the embossing nip, sufficient heat and pressure is imparted to the web(s) to cause the fibers within the web to soften and deform around each other. In the case of a multiply product, the heated embossing process can allow bonding to form between the plies.

In an alternative embodiment, the present invention is directed to a process and system for perforating a multi-ply paper product. In this embodiment, a perforating device is used to form rows of perforations along the length of the multi-ply product. In accordance with the present invention, during formation of the perforations, the plies are exposed to pressures sufficient to cause the fibers from each of the plies to bond together. Formation of the perforations can occur during heating of the plies, although heating is not required.

Base webs that may be used in the process of the present invention can vary depending upon the particular application. The paper products of the present invention may have single layer or multi-layer construction suitable for facial tissue, bath tissue, towels, wipers, and the like, though the process of the present invention has been found to be particularly suitable for tissue products.

The base web preferably includes pulp fibers. Pulp fibers suitable for the present invention include natural cellulosic fiber sources such as naked woods, softwoods, hardwoods, and non-woody species. In general, the pulp fibers can be present within the web in an amount of at least about 50% by weight. Specifically, pulp fibers can be present in the web in an amount of at least 80% by weight. The remainder of the web can be formed of any other suitable fiber type, such as, for example, recycled fibers, chemically modified fibers, bicomponent fibers, or synthetic fibers. In some embodiments, particularly those involving a tissue product, the web can be 100% pulp fibers.

The manner in which the base web of the present invention is formed can vary and is generally not critical to the present invention. For example, the individual plies of the present invention can be single layer webs, or alternatively can be stratified webs. Additionally, whether single layer or stratified webs are formed, the webs can be formed according to various possible processes.

For instance, in one embodiment, the web can be formed in a wet lay process according to conventional paper making techniques. In a wet lay process, the fiber furnish is combined with water to form an aqueous suspension. The aqueous suspension is then spread onto a wire or felt and dried to form the web.

Referring to FIG. 1, one embodiment of a process for producing a base web that may be used in accordance with the present invention is illustrated. The process illustrated in the figure depicts a wet lay process, although, as described above, other techniques for forming the base web of the present invention may be used.

As shown in FIG. 1, the web forming system includes a head box 10 for receiving an aqueous suspension of fibers. Head box 10 spreads the aqueous suspension of fibers onto a forming fabric 26 that is supported and driven by a plurality of guide rolls 34. A vacuum box 36 can be disposed beneath forming fabric 26 which is adapted to remove water from the fiber furnish in order to assist in forming a web.

From forming fabric 26, a formed web 38 can be transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. In an alternative embodiment, the transfer of web 38 from fabric 26 to fabric 40 can be facilitated by means such as a vacuum transfer shoe. The speed at which fabric 40 can be driven is approximately the same speed at which fabric 26 is driven so that movement of web 38 through the system is consistent. Alternatively, the two fabrics can be run at different speeds, such as in a rush transfer process, in order to increase the bulk of the webs or for some other purpose.

From fabric 40, web 38, in this embodiment, is pressed onto the surface of a rotatable heated dryer drum 46, such as a Yankee dryer, by a press roll 43. Web 38 is lightly pressed into engagement with the surface of dryer drum 46 to which it adheres, due to its moisture content and its preference for the smoother of the two surfaces. As web 38 is carried through a portion of the rotational path of the dryer surface, heat is imparted to the web causing most of the moisture contained within the web to be evaporated.

Web 38 is then removed from dryer drum 46 by a creping blade 47. Creping web 38 as it is formed reduces internal bonding within the web and increases softness.

In an alternative embodiment, instead of wet pressing the base web 38 onto a dryer drum and creping the web, the web can be through air dried. A through air dryer accomplishes the removal of moisture from the base web by passing air through the web without applying mechanical pressure.

Figure 2:
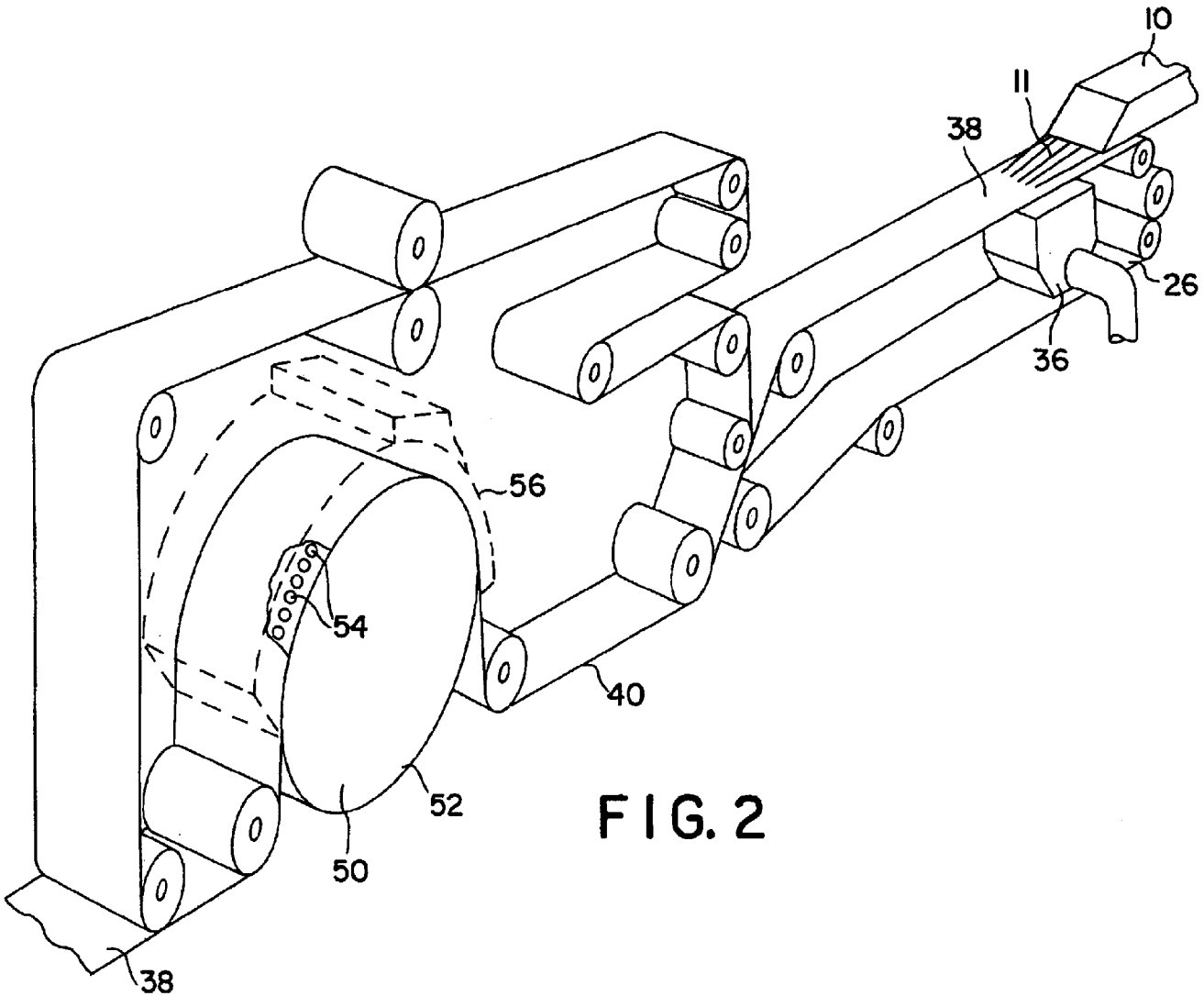
FIG. 2 is a perspective view with cut away portions of a fibrous web forming machine that includes a through air dryer for removing moisture from the web.

For example, referring to FIG. 2, an alternative embodiment for forming a base web for use in the process of the present invention containing a through air dryer is illustrated. As shown, a dilute aqueous suspension of fibers is supplied by a head box 10 and deposited via a sluice 11 in uniform dispersion onto a forming fabric 26 in order to form a base web 38.

Once deposited onto the forming fabric 26, water is removed from the web 38 by combinations of gravity, centrifugal force and vacuum suction depending upon the forming configuration. As shown in this embodiment, and similar to FIG. 1, a vacuum box 36 can be disposed beneath the forming fabric 26 for removing water and facilitating formation of the web 38.

From the forming fabric 26, the base web 38 is then transferred to a second fabric 40. The second fabric 40 carries the web through a through air drying apparatus 50. The through air drying apparatus 50 dries the base web 38 without applying a compressive force in order to maximize bulk. For example, as shown in FIG. 2, the through air drying apparatus 50 includes an outer rotatable cylinder 52 with perforations 54 in combination with an outer hood 56. Specifically, the fabric 40 carries the web 38 over the upper portion of the through air dryer outer cylinder 52. Heated air is drawn through perforations 54 which contacts the web 38 and removes moisture. In one embodiment, the temperature of the heated air forced through the perforations 54 can be from about 170° F. to about 500° F.

After the base web 38 is formed, such as through one of the processes illustrated in FIG. 1 or 2 or any other suitable process, it can be formed into a parent roll for further processing at a later time, or alternatively can be transferred directly to a converting or finishing area for embossing.

Figure 3:
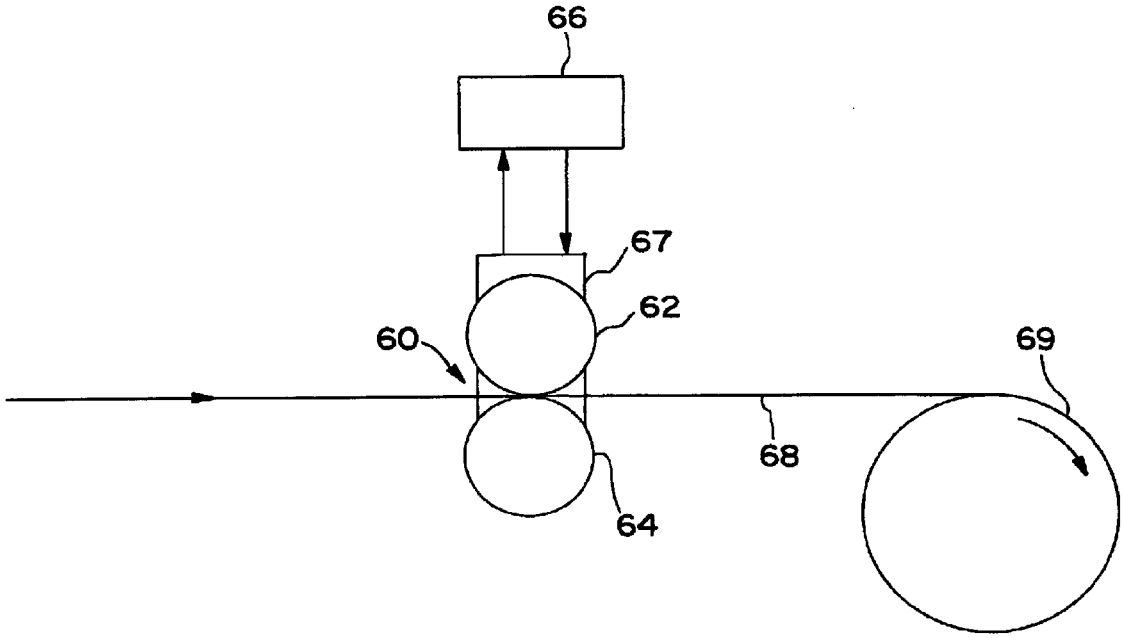
FIG. 3 is a schematic process flow diagram for a method of forming a tissue product which can be simultaneously embossed and bonded when passed between a pattern roll and a backing roll.

One possible embodiment of a process to hot emboss a paper sheet according to the present invention is illustrated in FIG. 3. As shown in the figure, base sheet 68 can be fed into heated embossing nip 60. Base sheet 68 is made up of all plies to be included in the final product. For example, in the case of a single ply product, the base sheet 68 will be equivalent to the base web previously formed which can be fed directly into the heated embossing nip 60 for the purpose of embossing the base sheet 68.

In an alternative embodiment, a multi-ply product can be formed. In this embodiment, the separate plies, once formed, can be brought adjacent to one another to form base sheet 68 prior to being fed into the heated embossing nip 60. For example, the separate plies of the multi-ply product can be brought adjacent to one another from separate parent rolls or directly from separate production lines by use of breast rolls suitably placed upstream of heated embossing nip 60.

The multi-ply tissue products of this invention can comprise two plies, three plies, or more. Similar to a single-ply product, the individual plies can be of any suitable construction, for example, layered or non-layered, creped or uncreped, etc. Each of the fiber layers of the multi-ply paper product can be formed of a dilute suspension of fibers, including pulp fibers, similar to a single-ply product.

The moisture content of the web as it passes into the heated embossing nip is not critical to the present invention and can vary depending on process conditions. For example, the web can be fairly dry when entering the embossing nip, and the moisture content of a single ply base sheet can be less than about 5% by weight of the base sheet. However, embossing a web with a higher moisture content can also provide a paper product having a well-defined embossed pattern. In fact, it has been discovered that a somewhat higher moisture content in the web can facilitate the glassining of the fibers in the web. For example, in certain embodiments, the web can have a moisture content when it enters the heated embossing nip about equal to the natural moisture content of the fibers making up the web. In one embodiment, the web can have a moisture content of between about 6% and about 8% when passing into the heated embossing nip 60.

The heated embossing nip 60 is formed between a pattern roll 62 and a backing roll 64. In accordance with the present invention, the embossing nip 60 is heated to a temperature above ambient during the embossing process of the base sheet 68. The heat and pressure applied to the sheet at the heated embossing nip 60 are sufficient to cause the fibers within the web to begin to plasticize. Particularly at those areas under the highest pressure, where the pattern elements are located on the pattern roll 62, also referred to as fiber bonding areas, the web fibers can become softer and begin to deform around one another. As the base sheet cools after it exits the heated embossing nip 60, the fibers in the fiber bonding areas can bond and become fused together resulting in a well-defined embossment at the fiber bonding areas of the sheet. Additionally, not only is the embossment well defined at production, retention of the embossing pattern is also increased due to the inter-fiber bonding and fusion.

Though unknown, it is believed by the inventors that the lignins within the pulp are particularly affected by the heat and pressure within the heated embossing nip 60. It is believed that the pulp lignins begin to melt or glassinate and take on a more amorphous, glassy condition during the process. The heated embossing process can therefore provide an improved, glassine appearance to the final paper product.

The process of the present invention also provides improvement over past embossing techniques. For example, many ply bonding processes in the past involved crimping techniques requiring high nip pressures in the crimper wheel area or alternatively applying adhesives between the plies in a separate ply bonding step. The process of the present invention, in contrast, provides for separate plies to be embossed and bonded at the same time, saving the process from any additional ply-bonding steps. During the heated embossing step, the fibers of one ply can bond with the fibers of an adjacent ply at the fiber bonding areas at the same time as the embossing pattern is being applied to the base sheet 68.

Additionally, it has been found that lower embossing nip pressures can be used in the present invention than those required in processes of the past due to the combination of the applied pressure with increased temperature. In the process of the present invention, embossing nip loading levels typically will not exceed 500 pli (pounds per linear inch). Generally, the embossing nip pressure can be between about 100 and about 400 pli. More specifically, the embossing nip pressure can be between about 150 and about 300 pli. In one embodiment, the embossing nip pressure can be about 150 pli. Lower pressure at the embossing nip can result in lower equipment costs and improved roll life as well as less sheet degradation in the embossed product sheet.

The temperature at the heated embossing nip 60 will be above ambient, with the specific desired temperature dependent upon various parameters, such as, for example, composition of the product, weld time required for bonding, number of plies, and residence time of the product in the heated embossing nip 60. In any case, temperatures should not exceed about 500° F., in order to prevent the product sticking to the rolls. Generally, the temperature at the heated embossing nip 60 can be between about 180° F. and about 490° F.

Residence time of the product within the heated embossing nip 60 can depend on line speed as well as roll diameters. In general, the residence time of the product in the heated embossing nip 60 can be between about 2.5 msec (milliseconds) and about 25 msec. In one embodiment, residence time in the heated embossing nip 60 can be about 4 msec. In general, the longer the residence time in the heated embossing nip 60, the lower the pressure and temperature required to obtain the desired amount of inter-fiber bonding.

Referring again to FIG. 3, one embodiment of a heated embossing process is shown. Base sheet 68 is fed into the heated embossing nip 60 formed between pattern roll 62 and backing roll 64. In this particular embodiment, heat is supplied to the embossing nip 60 by heating the pattern roll 62. For example, a liquid such as oil can be heated in a remote chamber 66 and continuously circulated via control valve 67 to route the oil along the interior surface of the pattern roll 62.

Other methods of heating pattern roll 62 may be by circulating a supply of heated water, gas, steam or the like. Alternatively, rather than circulating a heated fluid within the pattern roll 62, the pattern roll 62 could be heated by an electrical heat generating device or by way of induction heating. Other suitable methods of providing thermal energy to the heated embossing nip 60 could include infra-red, radiant or a conductive heat generating device. A combination of heating methods could also be employed.

In an alternative embodiment wherein the backing roll is not a rubber coated backing roll, backing roll 64 can be heated rather than the pattern roll 62. In another possible embodiment wherein the backing roll is not a rubber coated backing roll, both pattern roll 62 and backing roll 64 could be heated to the same or different temperatures simultaneously or alternatively. Additionally, one or both of the rolls could alternatively be internally or externally heated.

Additionally, base sheet 68 can be preheated prior to entering heated embossing nip 60. One possible method of preheating base sheet 68 can include guiding base sheet 68 around the heated embossing roll prior to entering the heated embossing nip 60. For example, base sheet 68 can be guided around the heated roll anywhere from about a 30° up to about a 270° wrap angle in order to preheat base sheet 68. Specifically, base sheet 68 can be wrapped around the heated roll from about a 45° to about a 90° wrap angle in order to preheat the base sheet 68. In one particular embodiment, wherein a multi-ply product is formed, the separate plies can be brought adjacent to one another prior to being wrapped around the heated roll in order to be preheated prior to entering the heated embossing nip 60. In one embodiment, the base sheet can be preheated to a temperature about equal to the temperature of the heated roll prior to entering the embossing nip.

Backing roll 64 can be any suitable backing roll which can support the nip pressure necessary to suitably emboss and bond the base sheet 68 under desired process conditions. However, as previously discussed, in those embodiments in which the backing roll is to be heated, it should not be a rubber coated backing roll. For example, backing roll 64 can be a mated steel roll having a pattern mated to the pattern roll 62. Alternatively, backing roll 64 can be a smooth steel roll, commonly referred to as an anvil roll. Still alternatively, backing roll 64 can include a rigid inner shell covered by a resilient elastomeric material, commonly referred to as a rubber coated roll. This particular style of backing roll has been found desirable in many embodiments due to the softness provided to the embossing nip by the elastomeric material as well as an ability to withstand the pressures and temperatures encountered at the embossing nip 60, thus providing the possibility of a longer roll life. The elastomeric material covering the resilient roll may be any suitable material, such as, for example, a polyurethane.

As previously discussed, the process of the present invention can be used to simply emboss a decorative pattern into a web. Alternatively, the process can be used to bond adjacent plies of a multi-ply product together. Additionally, separate plies can be bonded together at the same time an embossment is applied to the sheet.

Generally, the process of the present invention can include embossing a visible pattern into base sheet 68. As such, pattern roll 62 can include raised pattern elements. The pattern elements can form any desired decorative pattern in the base sheet. The decorative pattern can be visually recognizable and aesthetically pleasing. The decorative pattern can include straight lines, curved lines, flowers, butterflies, leaves, animals, toys, monograms, words, symbols, and the like. The pattern can be made up of separate discrete shapes or of reticulated grid. The pattern could also be some combination of a reticulated pattern and discrete shapes. In general, the pattern can cover between about 2% and about 60% of the surface area of the sheet. Specifically, the embossing pattern can cover from about 5% to about 30% of the surface area of the sheet. In some embodiments, the embossing pattern can cover up to about 15% of the surface area of the sheet.

While not known, it is believed that the embossing process of the present invention can improve the strength properties of the sheet. For instance, it is believed that the increased fiber density at the fiber bonding areas can provide mechanical strength or stability in the direction of the bonded areas. Thus, it is believed that a given pattern can be used to adjust and control the strength of the sheet in the machine direction or the cross machine direction.

Figure 4:
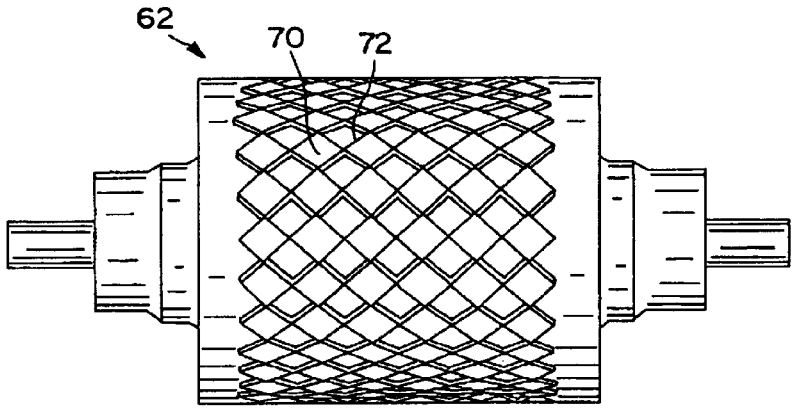
FIG. 4 is a schematic diagram of one possible embodiment of a pattern roll suitable for use in the process of the present invention.

One possible embodiment of pattern roll 62 is shown in greater detail in FIG. 4. The pattern roll 62 can be, for example, a rigid steel roll with the pattern elements formed by engraving or other suitable techniques. As can be seen, the surface of pattern roll 62 includes reticulated raised bonding elements 72 that are separated by smooth land areas 70. The raised bonding elements 72 are desirably arranged to form a decorative pattern, though the elements could alternatively be discrete elements arranged in a random fashion. Bonding elements 72 can be raised above the surface of the land areas 70 a distance such that the pressure in the embossing nip 60 at the intimate areas of contact between the bonding elements 72 and the base sheet 68 will be sufficient to emboss the base sheet 68 as desired. Generally, bonding elements 72 will be raised above land areas 70 at least about 0.01 inch and particularly from about 0.02 inch to about 0.06 inch.

Figure 5:
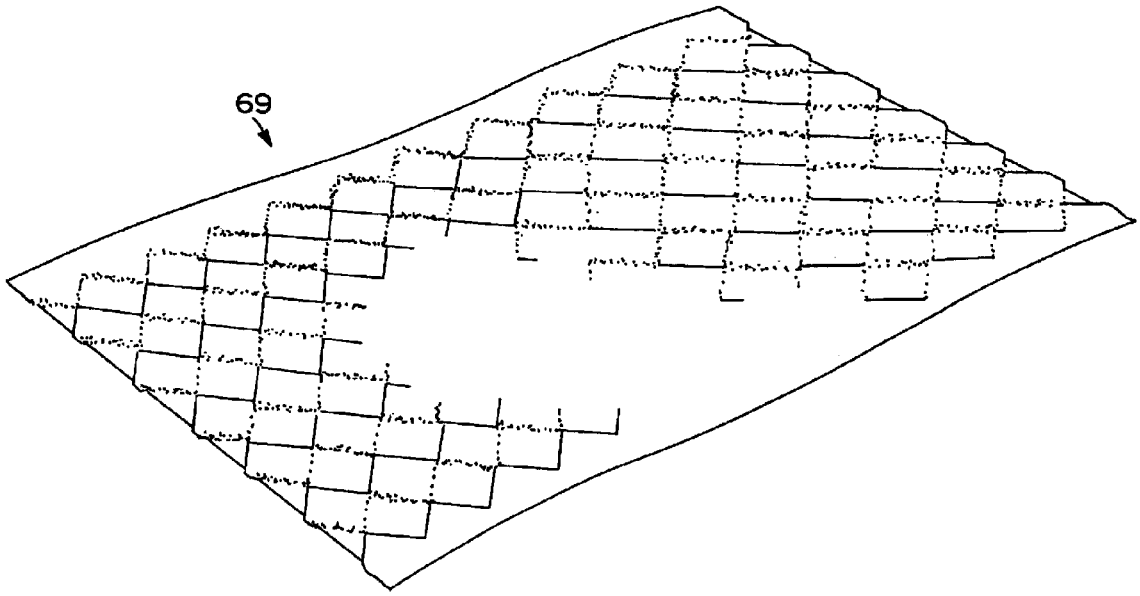
FIG. 5 is a schematic diagram of a paper product produced by the pattern roll shown in FIG. 4.

Referring to FIG. 5, a paper product 69 is shown that is intended to represent a product that would be formed in conjunction with the pattern roll 62 illustrated in FIG. 4.

Figure 6:
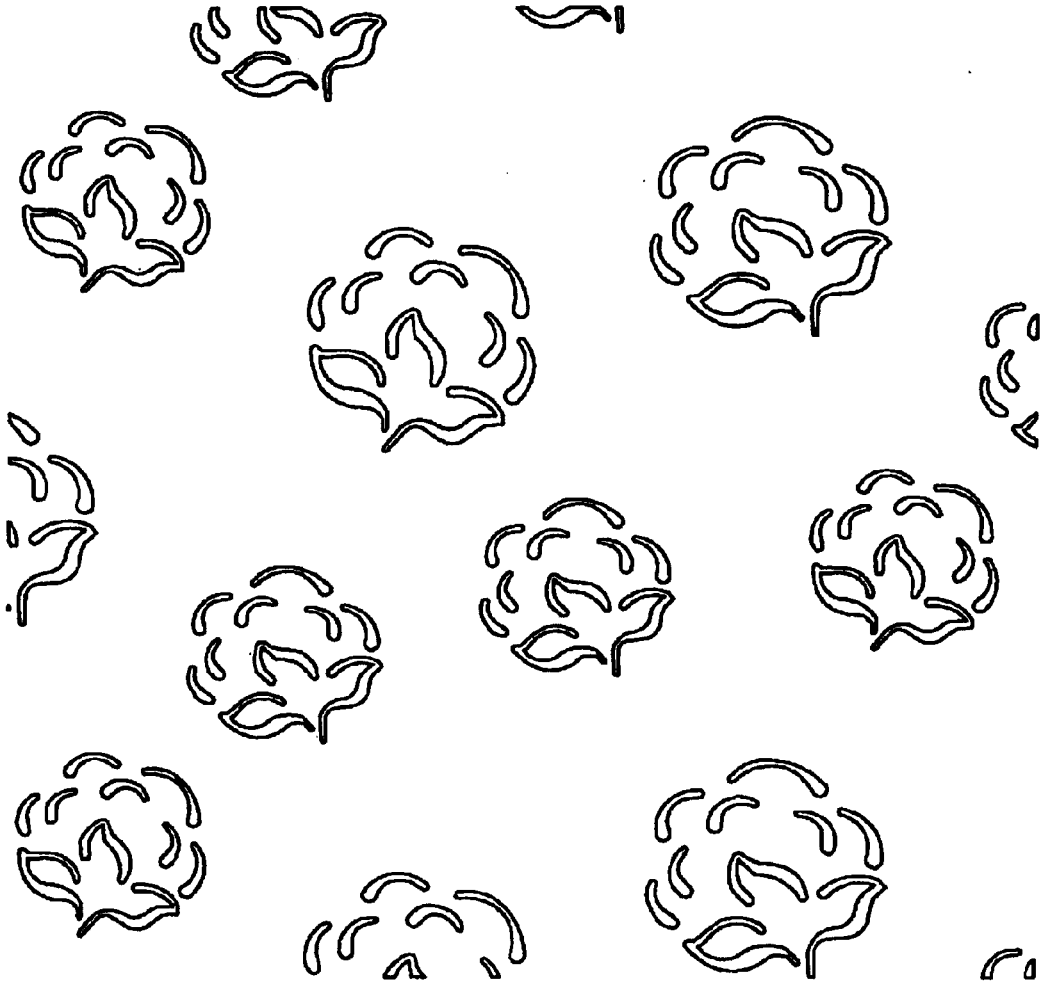
FIG. 6 is an alternative embossing pattern having a decorative cotton boll pattern.
Figure 7:
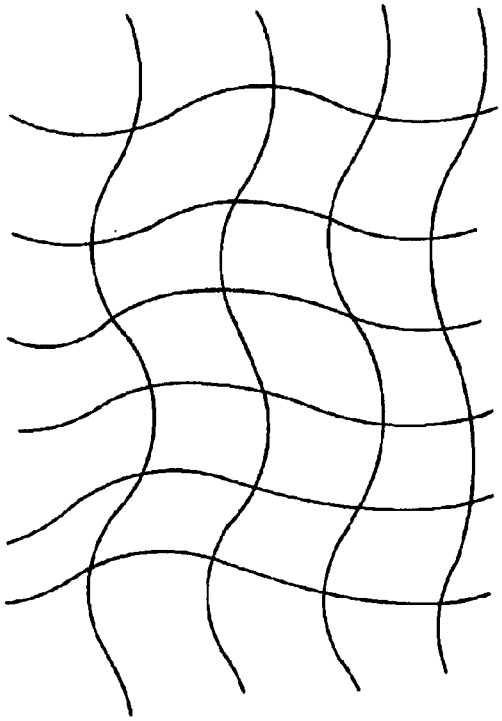
FIG. 7 is another alternative embodiment of an embossing pattern.
Figure 8:
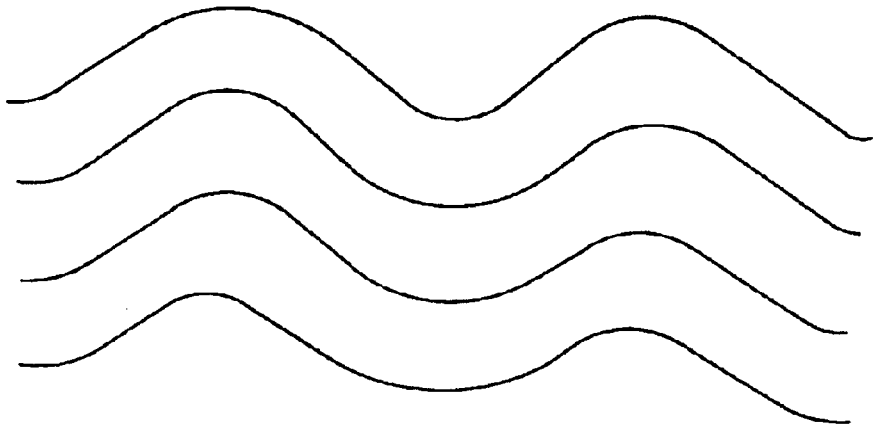
FIG. 8 is another alternative embodiment of an embossing pattern.

Other representative patterns are illustrated in FIGS. 6–8. FIG. 6 illustrates a cotton boll pattern formed of discrete shapes. Such a pattern could be employed when a relatively small bonding area is desired. For example about 7% of the surface area of the product sheet could be embossed using a pattern such as that illustrated in FIG. 6.

The embossing pattern illustrated in FIG. 7 could cover a greater surface area of the product sheet than that of FIG. 6. The pattern of FIG. 7 includes sinusoidal lines in both the machine and cross machine direction and can cover approximately 20–30% of the surface area of the product sheet.

FIG. 8 illustrates yet another alternative pattern embodiment. It includes sinusoidal lines extending in either the cross or machine direction. Such a pattern could cover about 15–20% of the total surface area of the sheet. Of course, any desired pattern could alternatively extend at any desired angle to the machine and cross machine directions.

The types of paper products that can be made according to the present invention vary widely. For instance, the process of the present invention can be used to produce paper towels or industrial wipers, and is particularly well suited to producing facial tissue and bath tissue. Paper towels and industrial wipers produced by the present invention generally can have an overall basis weight of from about 20 lbs per ream to about 70 lbs per ream.

When producing a tissue product, the product can generally have an overall basis weight of from about 6 lbs per ream (2880 sq. ft.) to about 50 lbs per ream. Additionally, a single ply of a tissue product, whether used alone or in conjunction with other plies, can have a density of from about 0.04 grams per cubic centimeter to about 0.3 grams per cubic centimeter. Absorbency of a tissue product is typically about 5 grams of water per gram of fiber, and generally from about 5 to about 9 grams of water per gram of fiber.

The paper product of the current invention may be further treated as desired. For instance, in addition to the heated embossing of the present invention, a product could be additionally processed by application of a printed decorative pattern or perhaps some other desired coating.

In an alternative embodiment, the present invention is also directed to a perforated multi-ply tissue product with improved ply bonding at and around the perforations, and a method and apparatus for making the same. Improved bonding at the perforations will provide a more robust tissue product that maintains its strength and absorbency when handled by the consumer. Of particular advantage, there is a diminished need for other means of ply bonding, means that may adversely affect the softness, absorbency, or other characteristics of the tissue.

Figure 13:
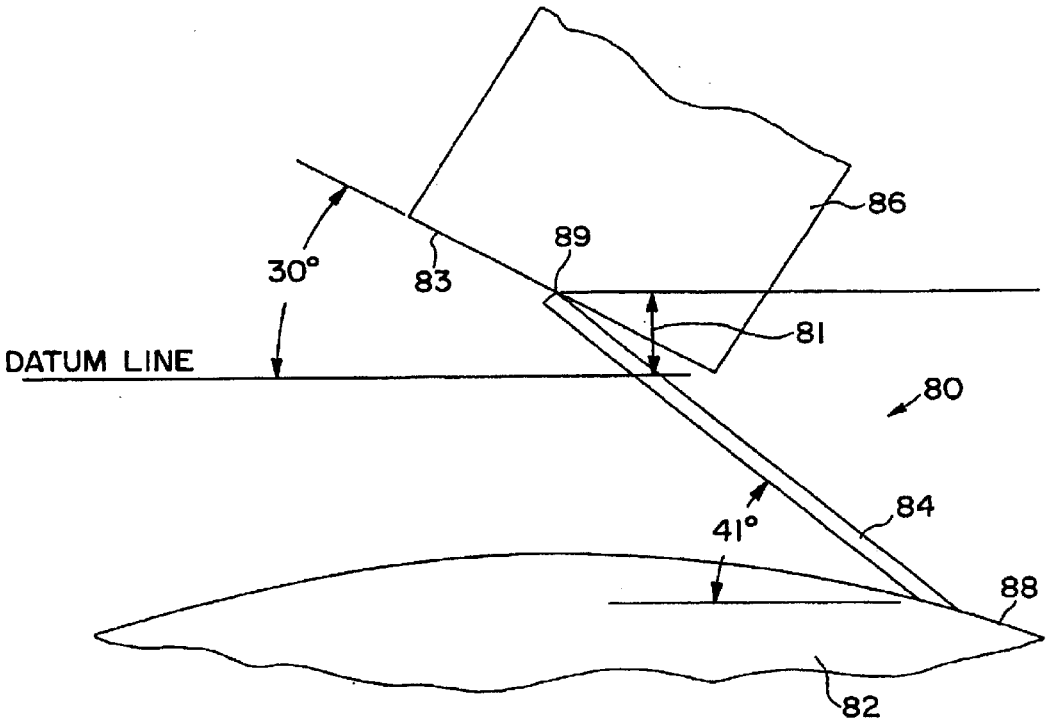
FIG. 13 PRIOR ART
FIG. 13 is side view of a prior art perforating device.

Referring to FIG. 13, an embodiment of a prior art apparatus is illustrated. As show, the tissue plies of a multiply paper product are typically perforated by perforating apparatus 80. In a typical perforating apparatus 80, at least one perforator blade 84 is attached to a rotating perforator head 82. The perforator blade 84 is a rectangular metal plate wherein the perforating edge 89 has a plurality of grooves (not shown) cut perpendicular to the length of the blade such that the blade only perforates and is incapable of cutting the tissue web completely. The perforator blade 84 is disposed axially and at the circumference 88 of the perforator head 82. In addition, the perforator blade 84 is typically angled away from the direction of rotation of the perforator head 82 so as to make an angle of about 41° with a datum line tangent to the circumference of the perforator head 82.

A stationary anvil 86 is disposed adjacent to the perforator head 82 such that the anvil 86 interferes with the path of the perforator blade 84. This interference 81 can range from about 1 mm to about 5 mm. The interfering surface 83 of the anvil 86 is typically flat and angled about 30° open with respect to a datum line tangent with the circumference of the perforator head 82. The surface 83 of the anvil 86 is configured to face the incoming perforator blade 84 and specifically the perforating edge 89.

The tissue web (not shown) is conveyed between the perforator blade 84 and the anvil 86 such that the web is perforated when the perforating edge 89 bears on the interfering surface 83 of the anvil 86. Typically, the web is conveyed at a speed substantially the same as the tangential velocity of the perforator blades 84.

The apparatus illustrated in FIG. 13 has been used in the past to perforate multi-ply paper products. The individual plies contained in the paper product, however, in most applications had to be attached together using an adhesive and/or by fiber entanglement. In this embodiment of the present invention, the present inventors have discovered a system and method for simultaneously perforating a multi-ply paper product and attaching the plies together. In particular, during the perforating operation, the plies are subjected to pressures sufficient to cause inter-fiber bonding to occur around the perforations. More particularly, the fibers within the plies are subjected to sufficient pressure to cause the fibers to plasticize, to soften or glassinate, and fuse. Thus, an adhesive or fiber entanglement is not needed in attaching the plys together.

Figure 9:
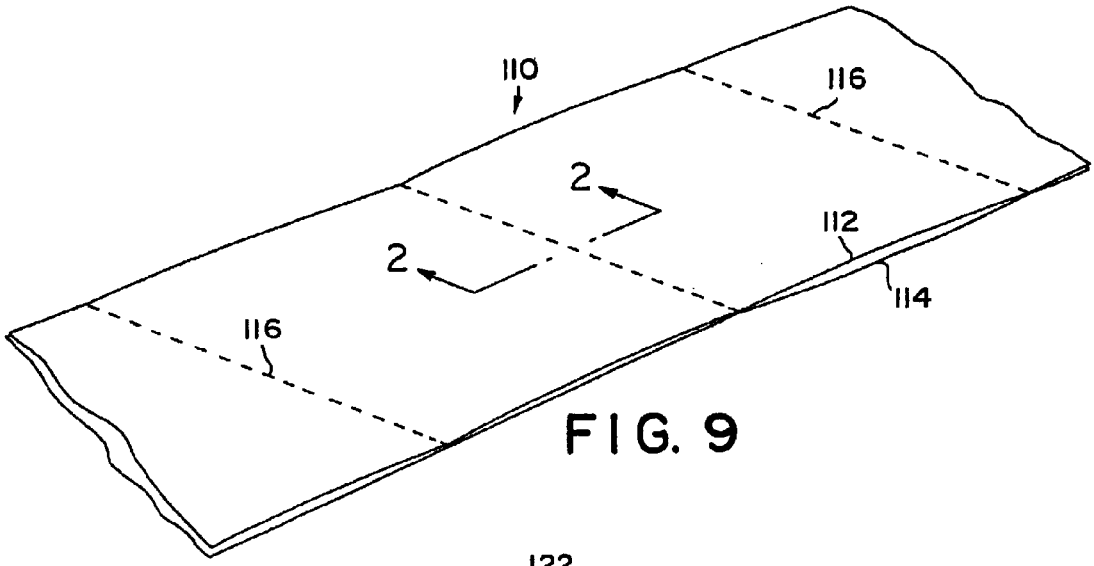
FIG. 9 is a perspective view of another embodiment of a paper product made in accordance with the present invention.

Referring to FIG. 9, one embodiment of a tissue product 110 made in accordance with the present invention is shown comprised of an upper ply 112 and a lower ply 114. The two plies are attached and perforated at periodic perforations 116.

Figure 10:
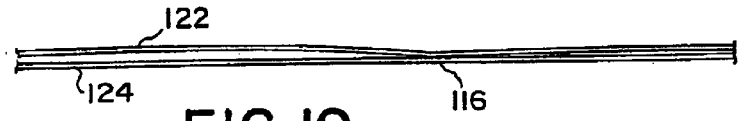
FIG. 10 is a side view of the product illustrated in FIG. 9.

Referring to FIG. 10, a cross-sectional view of the embodiment of FIG. 9 shows the upper ply 112 and lower ply 114. The upper ply 112 and the lower play 114 are attached and perforated at the perforation 116.

Figure 11:
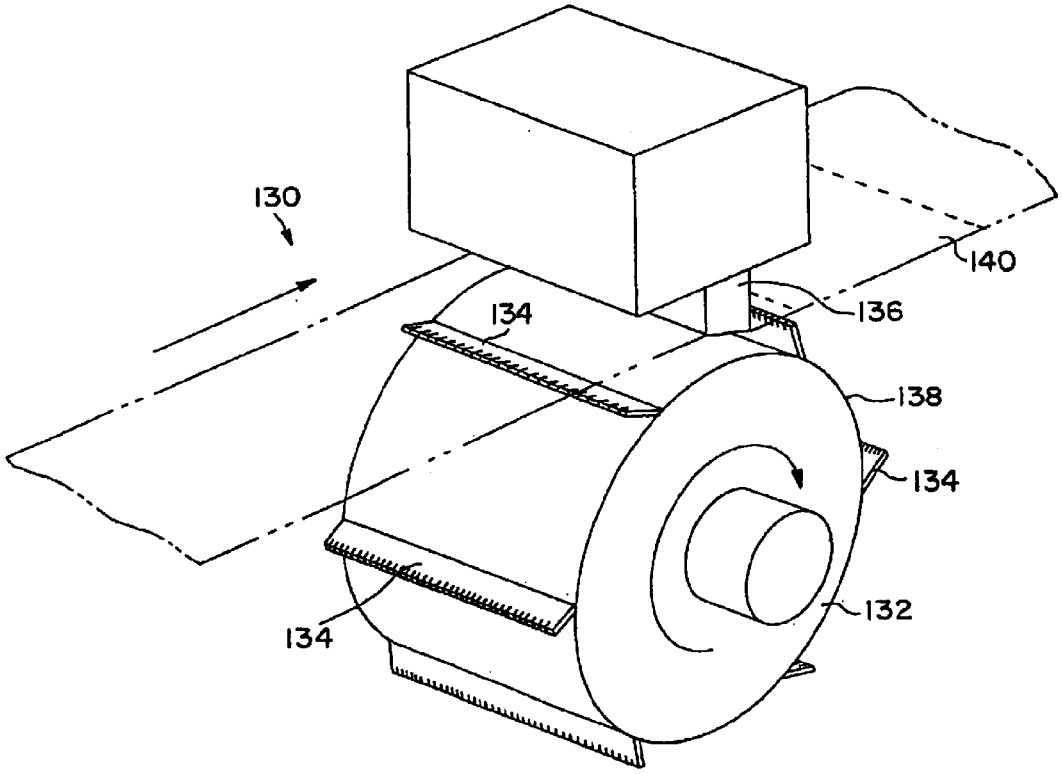
FIG. 11 is a perspective view of a perforating device made in accordance with the present invention.

Referring to FIG. 11, one embodiment of a perforating apparatus 130 for perforally attaching a plurality of plies in accordance with the present invention is shown. A perforator head 132 is fitted with a plurality of perforator blades 134 arranged about the circumference 138 of the perforator head 132. An anvil 136 is disposed adjacent to the perforator head 132 such that the anvil 136 interferes with the path of the rotating perforator blades 134. This interference can range from about 1 mm to about 8 mm.

The web 140 is conveyed between the perforator blades 134 and the anvil 136 such that it is perforated when the perforator blades 134 bear on the anvil 136. In accordance with the present invention, the anvil 136 forms an angle of less than 30° with the datum line tangent to the circumference 138 of the perforator head 132.

Figure 12:
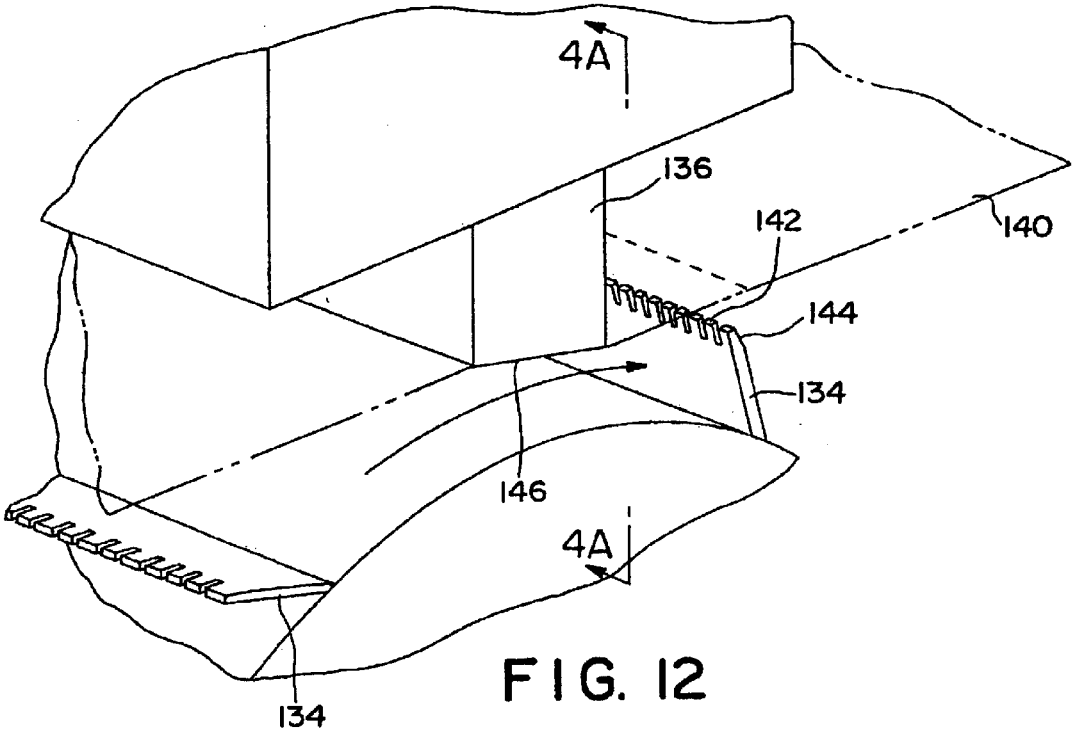
FIG. 12 is a perspective view with cutaway portions of the perforating device illustrated in FIG. 11.

Referring now to FIG. 12, a closer view of the embodiment of FIG. 11 is shown. The perforator blades 134, in accordance with the present invention and in addition to having a perforating edge 142, have a beveled face 144. The tissue web 140 is conveyed between the perforator blades 134 and the anvil 136 such that the tissue web 140 is perforated when the perforating edge 142 of the perforator blade 134 bears on the interfering surface 146 of the anvil 136. After the tissue web 140 is perforated, the tissue web 140 comprising tissue plies is then pinched between the interfering surface 146 of the anvil 136 and the beveled face 144 of the perforator blade 134 with sufficient pressure to cause the fibers of the tissue to glassine and fuse together and thereby attach.

Figure 15:
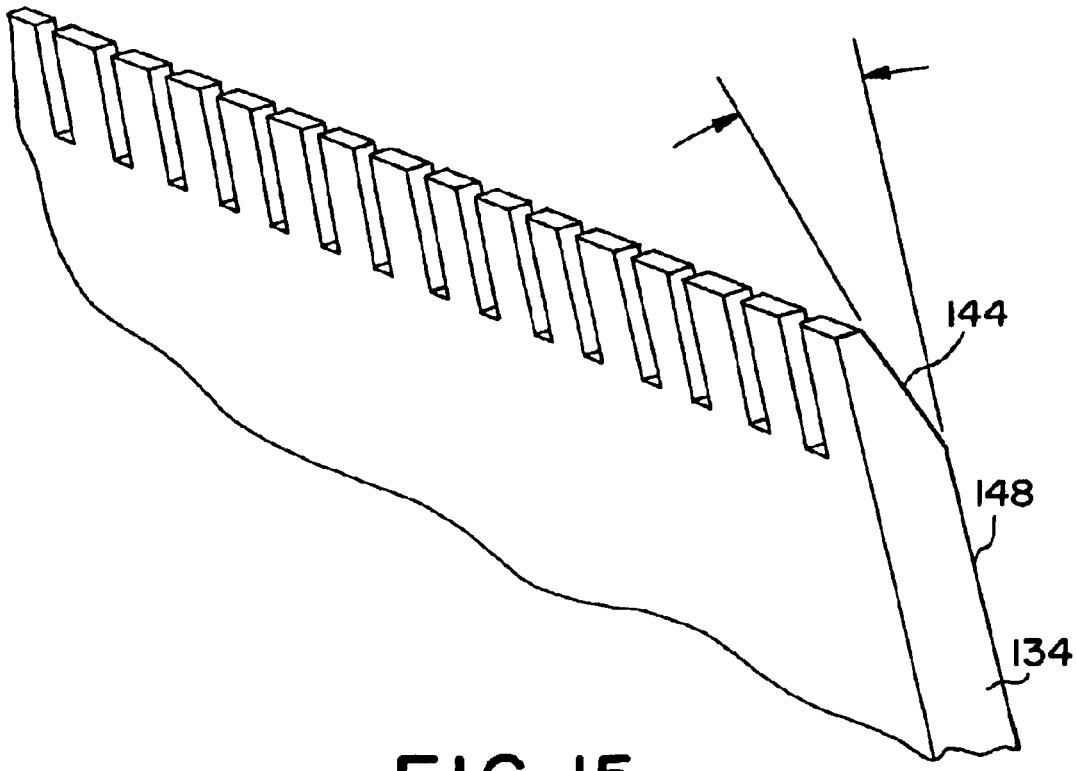
FIG. 15 is a perspective view with cutaway portions of one embodiment of a perforator blade for use in the system and process of the present invention.

Referring to FIG. 15, in accordance with the present invention, the beveled face 144 of the perforator blade 134 is beveled such that it forms an angle with the front surface 148 of the perforator blade 134 of between 0° and about 45°.

Figure 14A:
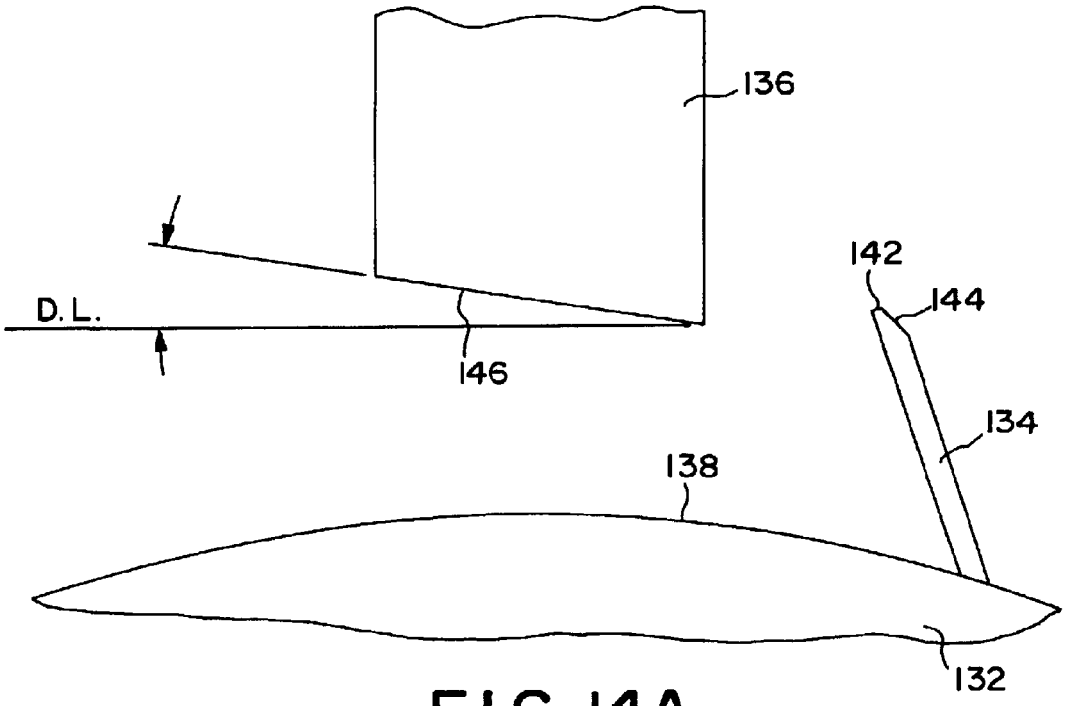
FIGS. 14A through 14D are side views illustrating sequential motion of the perforating device illustrated in FIG. 11.

Referring to FIG. 14A, a side view of FIG. 12, the orientation of the interfering surface 146 of the anvil 136 and the perforating edge 142 and beveled face 144 of the perforating blade 134 is more clearly shown. The angle formed by the horizontal datum line that is parallel to the tangent of the circumference 138 of the perforator head 132 and the interfering surface 146 is less than 30°. This results in a greater contact distance and contact time or "dwell time" between the beveled face 144 and the interfering surface 146 for a given interference.

Figure 14B:
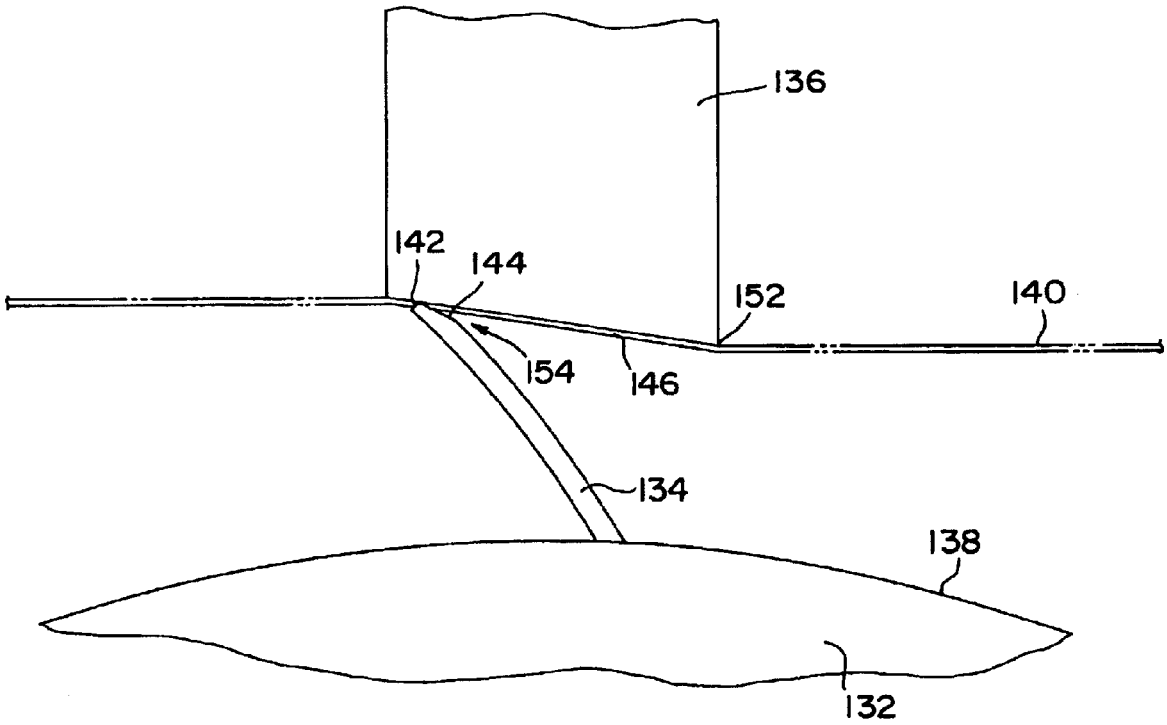
Figure 14C:
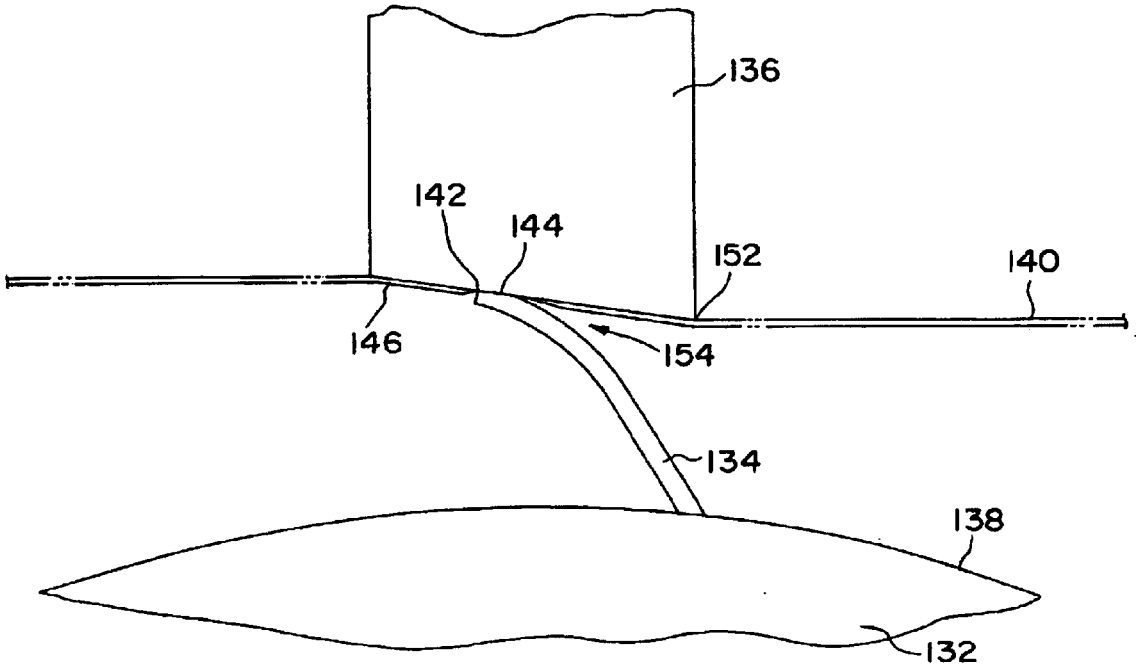
Figure 14D:
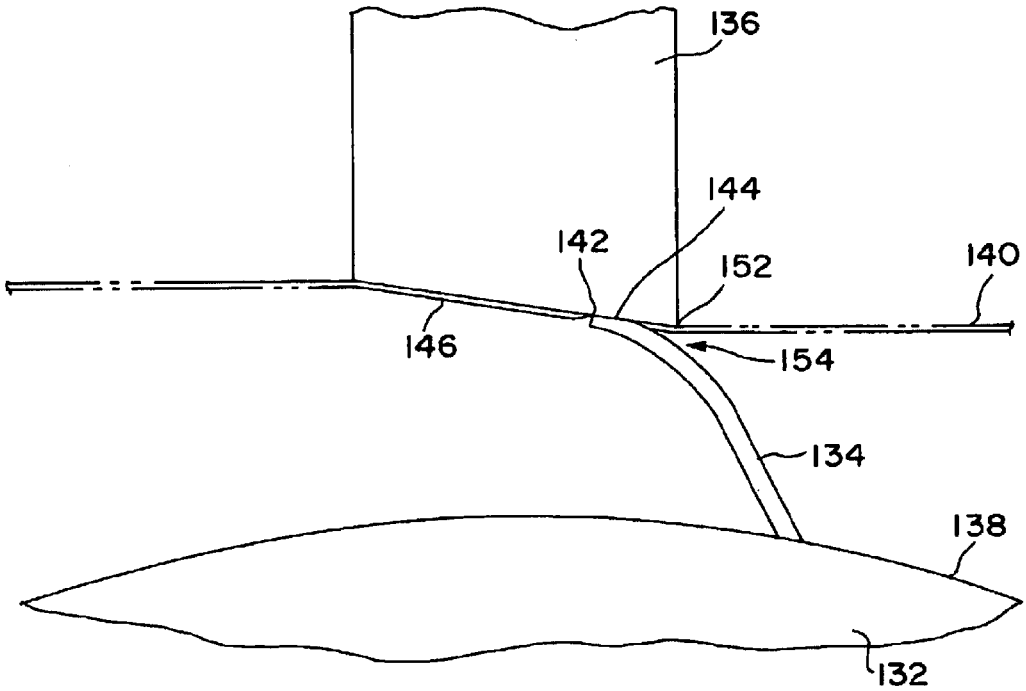

FIGS. 14B through 14D are sequential illustrations of one embodiment of the present invention as the embodiment perforates and attaches. Referring to FIG. 14B, the perforating edge 142 contacts the interfering surface 146 at some point proximal to an anvil edge 152. At or near this point, the tissue web 140 is perforated. As the perforator head 132 rotates and moves the perforating edge 142 along the interfering surface 146 of the anvil 136, the interference between the anvil 136 and the perforator blade 134 increases. This increased interference deflects the perforator blade causing the angle between the beveled face 144 and the interfering surface 146 to decrease. The space between the interfering surface 146 and the beveled face 144 or distal pocket 154 decreases as the perforating edge 142 of the perforating blade 134 is slid across the anvil 136. As the volume of the distal pocket 154 decreases, the tissue fibers therein are pressed together.

Referring to FIG. 14C, in contrast to FIG. 14B, the perforator head 132 has rotated further and the perforator blade 134 has moved further along the interfering surface 146 and is further deflected due to the increased interference. As a result of this deflection, the angle formed by the beveled face 144 and the interfering surface 146 is decreased further. In addition, the distal pocket 154 no longer exists.

Referring to FIG. 14D, in contrast to FIG. 14C, the perforator head 132 has rotated further and the perforator blade 134 has moved further along the interfering surface 146 and is further deflected due to the increased interference. As a result of this deflection, the angle formed by the beveled face 144 and the interfering surface 146 is decreased even further. In addition, the tissue is subjected to a pressure sufficient to cause the fibers of the plies to glassine and become joined.

In an alternative embodiment of the present invention, the tissue fibers containing the beveled face 144 are, in addition to being pressed together, heated sufficiently to cause or aid glassining of the fibers. This is accomplished by heating the anvil 136, heating the perforator blade 134, or heating the anvil 136 and perforator blade 134. The perforator blade 134 can be heated directly or indirectly by heating the perforator head 132. The anvil 136 can be heated directly or indirectly by heating the anvil's housing (not shown). Heating can be done, for instance, through electrical resistance or by circulating a heated fluid through the desired parts of the system.

In another alternative embodiment of the present invention, the perforator head 132 is rotated such that the tangential speed of the perforating edge 142 is faster than the speed of the tissue web 140 by a factor of 1.5 to 10. In this embodiment, as the perforating edge 142 moves across the interfering surface 146 of the anvil 136, it is moving substantially faster than the tissue web 140. As a result, the perforating edge 142 not only perforates the tissue web 140 but also bunches tissue together adjacent to the beveled face 144. This results in a greater volume of tissue contained in the distal pocket 154. The tissue gathered in the distal pocket then is pressed according to the interaction of the beveled face 144 and the interfering surface 146 as described above. The glassining of a greater volume of tissue fibers results in a larger and more secure bond in the area of the perforations.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. An embossed paper product comprising:

a base web, said base web having a basis weight of from about 6 lb2880 sq. ft. to about 70 lb2880 sq. ft., said base web comprising pulp fibers; and a well-defined, decorative pattern embossed into said base web by means of heat and pressure applied at a heated embossing nip formed between a rigid pattern roll and a backing roll covered by a resilient elastomeric material, said pattern being defined by fiber bonding areas, said fiber bonding areas comprising regions where said pulp fibers have been bonded together by means of the heat and pressure applied at the heated embossing nip, the bonding areas being at least 0.02 inches deep, said decorative pattern covering from about 2% to about 60% of the surface area of the base web, said decorative pattern extending to the central portion of the base web.

2. An embossed paper product as defined in claim 1, wherein said decorative pattern exhibits a glassine appearance.

3. An embossed paper product as defined in claim 1, wherein said embossed paper product is a tissue product.

4. An embossed paper product as defined in claim 3, wherein said pulp fibers comprise at least 80% by weight of said base web.

5. An embossed paper product as defined in claim 3, wherein said base web consists essentially of pulp fibers.

6. An embossed paper product as defined in claim 1, wherein said paper product comprises more than one ply and wherein said plies are bonded together within the fiber bonding areas by means of heat and pressure applied at the heated embossing nip.

7. An embossed paper product as defined in claim 1, wherein said base web has an absorbency of from about 5 grams $H_2O$/gram fiber to about 9 gram $H_2O$/gram fiber.

8. An embossed paper product as defined in claim 1, wherein said decorative pattern comprises a repeating pattern of discrete shapes.

9. An embossed paper product as defined in claim 1, wherein said decorative pattern comprises a reticulated pattern.

10. An embossed paper product as defined in claim 1, wherein said decorative pattern comprises from about 5% to about 30% of the total surface area of said base web.

11. An embossed paper product as defined in claim 1, wherein the embossing nip is heated to a temperature which does not exceed about 500° F.

12. An embossed paper product as defined in claim 1, wherein said pressure is applied at a load of less than about 500 pli.

13. An embossed paper product as defined in claim 1, wherein the embossing nip is heated to a temperature between about 180° F. and about 490° F.

14. An embossed paper product as defined in claim 1, wherein said decorative pattern comprises between about 15% and about 20% of the total surface area of said base web.

15. An embossed paper product as defined in claim 1, wherein said decorative pattern comprises between about 20% and about 30% of the total surface area of said base web.

16. An embossed paper product as defined in claim 1, wherein said decorative pattern comprises between about 2% and about 15% of the total surface area of said base web.

17. An embossed paper product as defined in claim 1, wherein said bonding areas being from about 0.02 inches to about 0.06 inches deep.

18. A multi-ply paper product comprising:

a first base web, said first base web having a basis weight of from about 6 lb/2880 sq. ft. to about 70 lb/2880 sq. ft., said first base web comprising pulp fibers;

a second base web, said second base web having a basis weight of from about 6 lb2880 sq. ft. to about 70 lb/2880 sq. ft.; and wherein said first and second base webs are bonded together and simultaneously embossed with a well-defined, decorative pattern by means of heat and pressure applied at a heated embossing nip formed between a rigid pattern roll and a backing roll covered by a resilient elastomeric material, said pattern being defined by fiber bonding areas, said fiber bonding areas comprising regions where said pulp fibers have been bonded together by means of the heat and pressure applied at the heated embossing nip, the bonding areas being at least 0.02 inches deep, said decorative pattern covering from about 2% to about 60% of the surface area of the paper product and extending to the central portion of the paper product.

19. A multi-ply paper product as defined in claim 18, wherein said decorative pattern exhibits a glassine appearance.

20. A multi-ply paper product as defined in claim 18, wherein said multi-ply paper product is a tissue product.

21. A multi-ply paper product as defined in claim 20, wherein said pulp fibers comprise at least about 80% by weight of said multi-ply paper product.

22. A multi-ply paper product as defined in claim 20, wherein said multi-ply paper product consists essentially of pulp fibers.

23. A multi-ply paper product as defined in claim 18, wherein said base web has an absorbency of from about 5 grams $H_2O$/gram fiber to about 9 gram $H_2O$/gram fiber.

24. A multi-ply paper product as defined in claim 18, wherein said decorative pattern comprises a repeating pattern of discrete shapes.

25. A multi-ply paper product as defined in claim 18, wherein said decorative pattern comprises a reticulated pattern.

26. A multi-ply paper product as defined in claim 18, wherein said decorative pattern comprises from about 5% to about 30% of the total surface area of said base web.

27. A multi-ply paper product as defined in claim 18, wherein said pressure is applied at a load of less than about 500 pli.

28. A multi-ply paper product as defined in claim 18, wherein said pressure is applied at a load of between about 100 pli and about 400 pli.

29. A multi-ply paper product as defined in claim 18, wherein the embossing nip is heated to a temperature of less than about 500° F.

30. A multi-ply paper product as defined in claim 18, wherein the embossing nip is heated to a temperature between about 180° F. and about 490° F.

31. A multi-ply paper product as defined in claim 18, wherein said decorative pattern comprises between about 15% and about 20% of the total surface area of the multi-ply paper product.

32. A multi-ply paper product as defined in claim 18, wherein said decorative pattern comprises between about 20% and about 30% of the total surface area of the multi-ply paper product.

33. A multi-ply paper product as defined in claim 18, wherein said decorative pattern comprises between about 2% and about 15% of the total surface area of the multi-ply paper product.

34. A multi-ply product as defined in claim 18, wherein said bonding areas being from about 0.02 inches to about 0.06 inches deep.

* * * * *

UNITED STATES PATENT AND TRADEMARK OFFICE

CERTIFICATE OF CORRECTION

PATENT NO. : 6,913,673 B2
DATED : July 5, 2005
INVENTOR(S) : James L. Baggot et al.

It is certified that error appears in the above-identified patent and that said Letters Patent is hereby corrected as shown below:

Column 12,
Line 27, "6 lb2880" should be -- 6 lb/2880 --.
Line 27, "70 lb2880" should be -- 70 lb/2880 --.

Column 13,
Line 28, "6 lb2880" should be -- 6 lb/2880 --.

Signed and Sealed this

Fourth Day of April, 2006

JON W. DUDAS
*Director of the United States Patent and Trademark Office*